US012663172B2

(12) United States Patent
Raasch et al.

(10) Patent No.: US 12,663,172 B2
(45) Date of Patent: Jun. 23, 2026

(54) INTEGRATION OF A THERMAL ENERGY STORAGE UNIT WITH AN EXTERNAL HVAC SYSTEM

(71) Applicant: Ice Bear SPV #1, LLC, Costa Mesa, CA (US)

(72) Inventors: Joseph Ohne Raasch, Costa Mesa, CA (US); Joseph Condon, Oak Hills, CA (US)

(73) Assignee: ICE ENERGY, INC., Costa Mesa, CA (US)

( * ) Notice: Subject to any disclaimer, the term of this patent is extended or adjusted under 35 U.S.C. 154(b) by 239 days.

(21) Appl. No.: 18/132,776

(22) Filed: Apr. 10, 2023

(65) Prior Publication Data

US 2024/0337394 A1 Oct. 10, 2024

(51) Int. Cl.
*F24F 5/00* (2006.01)

(52) U.S. Cl.
CPC ..... *F24F 5/0017* (2013.01)

(58) Field of Classification Search
CPC ..... F24F 5/0017; F28D 2020/0004; F25B 2400/053; F25B 25/005; F25D 16/00
See application file for complete search history.

(56) References Cited

U.S. PATENT DOCUMENTS 1,954,455 A * 4/1934 Morse ..... F24F 5/0017 62/96
2,737,027 A * 3/1956 Kleist ..... F24F 5/0017 62/332
3,653,221 A * 4/1972 Angus ..... F25B 5/00 62/223
4,608,836 A * 9/1986 MacCracken ..... F25D 17/02 165/59
4,757,690 A * 7/1988 Holowczenko ..... F24F 5/0017 165/905
5,307,642 A * 5/1994 Dean ..... F25D 16/00 62/332
5,323,618 A * 6/1994 Yoshida ..... F25B 1/00 165/902
5,647,225 A * 7/1997 Fischer ..... F24F 5/0017 62/434
5,678,626 A * 10/1997 Gilles ..... H02J 3/28 165/62
5,724,827 A * 3/1998 Yamaguchi ..... F24F 5/0017 62/434
5,884,493 A * 3/1999 Karstrom ..... H05K 7/20354 62/99
5,894,739 A * 4/1999 Temos ..... F24F 5/0017 62/436
6,158,499 A * 12/2000 Rhodes ..... F24F 5/0017 165/902
6,178,770 B1 * 1/2001 Bradley, Jr. ..... F28D 20/021 165/172
6,182,454 B1 * 2/2001 McNeilan ..... F24F 11/0008 62/185

(Continued)

*Primary Examiner* — Travis Ruby
(74) *Attorney, Agent, or Firm* — SOQUEL GROUP LLC

(57) ABSTRACT

Disclosed are a system and method and device for providing cooling to an external heating, ventilation and air conditioning (HVAC) system from a refrigerant-based thermal storage system with an ice-tank heat exchanger that cools a refrigerant that is circulated to the HVAC system during an ice make mode.

12 Claims, 12 Drawing Sheets

(56) References Cited

U.S. PATENT DOCUMENTS 6,253,567 B1* 7/2001 Imanari ..... F24F 5/0017 62/434
2005/0081557 A1* 4/2005 McRell ..... F25D 16/00 62/434
2005/0132734 A1* 6/2005 Narayanamurthy .. F24F 5/0017 62/434
2005/0262870 A1* 12/2005 Narayanamurthy .... F25D 16/00 62/434
2006/0037329 A1* 2/2006 Narayanamurthy .. F24F 5/0017 62/434
2006/0070385 A1* 4/2006 Narayanamurthy .... F25D 16/00 62/434
2007/0095093 A1* 5/2007 Narayanamurthy .... F25D 16/00 62/434
2008/0022713 A1* 1/2008 Jacobi ..... F24F 5/0017 62/434
2008/0034760 A1* 2/2008 Narayanamurthy .. F24F 5/0017 62/434
2009/0133412 A1* 5/2009 Narayanamurthy .... F25D 16/00 62/66
2009/0288437 A1* 11/2009 Matsuoka ..... F25B 25/005 62/238.6
2009/0293507 A1* 12/2009 Narayanamurthy .. F24F 5/0017 62/509
2010/0089080 A1* 4/2010 Koh ..... F25B 13/00 62/132
2011/0048037 A1* 3/2011 Graslund ..... F28D 20/0052 62/260
2017/0261242 A1* 9/2017 Yasuo ..... F24F 11/30
2021/0207834 A1* 7/2021 Ukibune ..... F24F 11/47
2022/0186963 A1* 6/2022 Zhou ..... F25B 41/39
2024/0068714 A1* 2/2024 Taras ..... F24F 5/0017
2024/0337394 A1* 10/2024 Raasch ..... F24F 5/0017
2024/0361045 A1* 10/2024 Raasch ..... F25B 41/40
2024/0361052 A1* 10/2024 Raasch ..... F25B 43/006

* cited by examiner

VALVE STATUS CONDITIONS FOR A THERMAL ENERGY STORAGE AND COOLING SYSTEM WITH SECONDARY REFRIGERANT ISOLATION

| System Mode | Valve | Condition |
|---|---|---|
| **Ice Make** (charging) *Figure 3* | 1 | Closed |
| | 2 | ═ |
| | 3 | ‖ |
| | 4 | ⊓ |
| **Ice Melt** (cooling) *Figure 4* | 1 | Open |
| | 2 | ⊔ |
| | 3 | ⊔ |
| | 4 | ⊔ |
| **Direct Cooling** (bypass) *Figure 5* | 1 | Open |
| | 2 | ⊔ |
| | 3 | Closed |
| | 4 | ⊔ |

FIG. 2

INTEGRATION OF A THERMAL ENERGY STORAGE UNIT WITH AN EXTERNAL HVAC SYSTEM

CROSS REFERENCE TO RELATED APPLICATIONS

This application is based upon and improves upon U.S. Pat. No. 7,363,772, entitled "Thermal energy storage and cooling system with secondary refrigerant isolation", filed Aug. 18, 2005, the entire disclosure of which is hereby specifically incorporated by reference for all that it discloses and teaches.

BACKGROUND OF THE INVENTION a. Field of the Invention

The present invention relates generally to systems providing stored thermal energy in the form of ice to provide cooling load during peak electrical demand, and more specifically to integration of a refrigerant-based thermal storage and cooling system with an external heating, ventilation and air conditioning (HVAC system).

b. Description of the Background

With the increasing demands on peak demand power consumption, ice storage has been utilized to shift air conditioning power loads to off-peak times and rates. A need exists not only for load shifting from peak to off-peak periods, but also for increases in air conditioning unit capacity and efficiency. Current air conditioning units having energy storage systems have had limited success due to several deficiencies including reliance on water chillers that are practical only in large commercial buildings and have difficulty achieving high-efficiency. In order to commercialize advantages of thermal energy storage in large and small commercial buildings, thermal energy storage systems must have minimal manufacturing costs, maintain maximum efficiency under varying operating conditions, emanate simplicity in the refrigerant management design, and maintain flexibility in multiple refrigeration or air conditioning applications.

Systems for providing thermal stored energy have been previously contemplated in U.S. Pat. Nos. 4,735,064, 4,916,916, both issued to Harry Fischer, U.S. Pat. No. 5,647,225 issued to Fischer et al., U.S. patent application Ser. No. 10/967,114 filed Oct. 15, 2004 by Narayanamurthy et al., U.S. patent application Ser. No. 11/112,861 filed Apr. 22, 2005 by Narayanamurthy et al., and U.S. patent application Ser. No. 11/138,762 filed May 25, 2005 by Narayanamurthy et al. All of these patents utilize ice storage to shift air conditioning loads from peak to off-peak electric rates to provide economic justification and are hereby incorporated by reference herein for all they teach and disclose.

SUMMARY OF THE INVENTION

Disclosed are a system and a method for providing cooling to an external heating, ventilation and air conditioning (HVAC) system from a refrigerant-based thermal storage system with ice-tank heat exchanger that cools a refrigerant that is circulated to the HVAC system during an ice make mode.

An embodiment of the present invention may comprise a refrigerant-based thermal energy storage and cooling system that operates in two modes, an ice make mode and an ice melt mode, and provides cooling to an external heating, ventilation and air conditioning (HVAC) unit, including a first refrigerant loop that circulates a first refrigerant, which includes an evaporator that cools the first refrigerant, a second refrigerant loop containing a second refrigerant, the second refrigerant loop including a tank filled with a fluid capable of a phase change between liquid and solid, wherein the tank uses the second refrigerant to cool the fluid and to freeze at least a portion of the fluid within the tank, wherein during ice melt mode the frozen fluid cools the second refrigerant, an isolating heat exchanger, which has a portion inside the first refrigerant loop and a portion inside the second refrigerant loop, and which during ice make mode uses the cooled first refrigerant circulating in the first refrigerant loop to cool the second refrigerant circulating within the second refrigerant loop, a thermal cooling (TC) controller that receives a signal from an external HVAC system to pump cooled second refrigerant from the second refrigerant loop, and a thermal cooling (TC) evaporator coil, physically integrated within the HVAC unit, which receives the cooled second refrigerant from the second refrigerant loop, thus enabling the TC evaporator coil to provide cooling to the external HVAC unit.

An embodiment of the present invention may further comprise a refrigerant-based thermal energy storage and cooling system comprising: a first refrigerant loop containing a first refrigerant; a second refrigerant loop containing a second refrigerant, the second refrigerant that is a different material than the first refrigerant; an isolating heat exchanger disposed between the first refrigerant loop and the second refrigerant loop for thermal communication therebetween; and, a load heat exchanger within the second refrigerant loop that transfers thermal capacity of the second refrigerant to a load.

An embodiment of the present invention may further comprise a method of providing cooling with a refrigerant-based thermal energy storage and cooling system providing cooling to an external heating ventilation and air conditioning (HVAC) system, wherein the TC system operates in an ice make mode or an ice melt mode, including the steps of receiving a signal from an external HVAC system requesting cooling, determining that the TC system is in ice melt mode, starting a refrigerant pump that circulates cool refrigerant from the thermal cooling system through an evaporator coil that is physically integrated with the HVAC system, running the refrigerant pump for a designated interval of time, upon determining that the HVAC system still requests cooling running the refrigerant pump for a second designated interval of time; and upon determining that the HVAC system no longer requests cooling or that the TC system is no longer in ice melt mode halting the refrigerant pump.

BRIEF DESCRIPTION OF THE DRAWINGS

The disclosed embodiments have other advantages and features which will be more readily apparent from the detailed description, the appended claims, and the accompanying figures (or drawings). A brief introduction of the figures is below.

FIG. 2 is a table representing valve status conditions for the refrigerant-based thermal energy storage and cooling system with secondary refrigerant isolation illustrated in FIG. 1.

Figure 1:
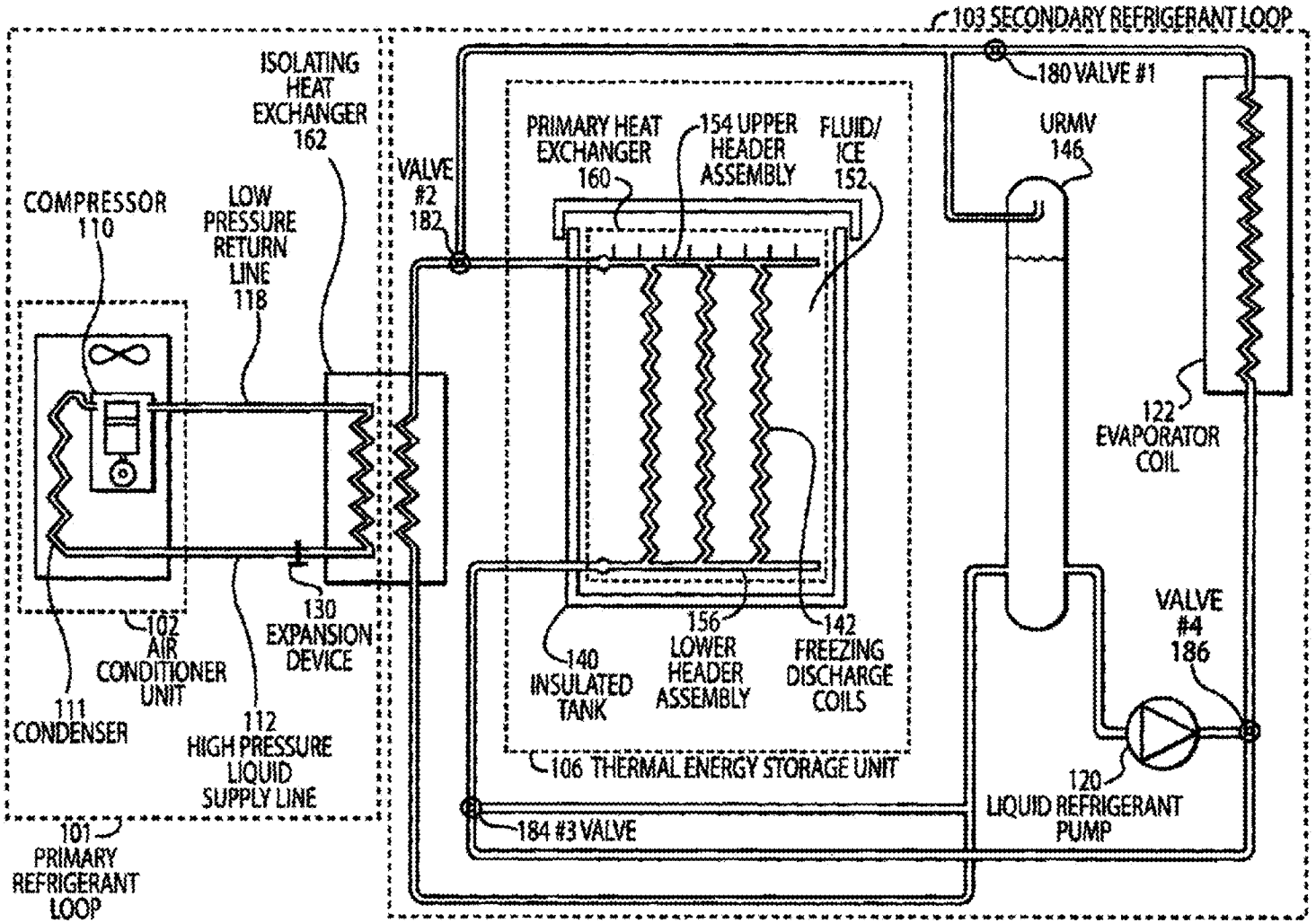
FIG. 1 illustrates an embodiment of a refrigerant-based thermal energy storage and cooling system with secondary refrigerant isolation.

The figures depict embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION OF THE INVENTION

While this invention is susceptible to embodiment in many different forms, there is shown in the drawings and will be described herein in detail specific embodiments thereof with the understanding that the present disclosure is to be considered as an exemplification of the principles of the invention and is not to be limited to the specific embodiments described.

The disclosed embodiments overcome the disadvantages and limitations of the prior art by providing a refrigerant-based thermal storage system method and device wherein a condensing unit and an ice-tank heat exchanger can be isolated through a second heat exchanger. As illustrated in FIG. 1, an air conditioner unit 102 utilizing a compressor 110 to compress cold, low pressure refrigerant gas to hot, high-pressure gas. Next, a condenser 111 removes much of the heat in the gas and discharges the heat to the atmosphere. The refrigerant comes out of the condenser as a warm, high-pressure liquid refrigerant delivered through a high-pressure liquid supply line 112 to an isolating heat exchanger 162 through an expansion valve 130. Expansion valve 130 may be a conventional thermal expansion valve, a mixed-phase regulator and surge vessel (reservoir) or the like. Low-pressure vapor phase and liquid refrigerant is then returned to compressor 110 via low pressure return line 118 completing the primary refrigeration loop.

Cooling is transferred to a secondary refrigeration loop including a thermal energy storage unit 106 through the isolating heat exchanger 162. The thermal energy storage unit 106 comprises an insulated tank 140 that houses the primary heat exchanger 160 surrounded by fluid/ice depending on the current system mode. The primary heat exchanger 160 further comprises a lower header assembly 156 connected to an upper header assembly 154 with a series of freezing and discharge coils 142 to make a fluid/vapor loop within the insulated tank 140. The upper and lower header assemblies 154 and 156 communicate externally of the thermal energy storage unit 106 with inlet and outlet connections.

An evaporator coil 122 is connected within the secondary closed loop refrigeration circuit to the isolating heat exchanger 162 to transmit cooling from the air conditioner unit 102 to a load in one mode (ice melt mode). Evaporator coil 122 is also connected within the secondary closed loop refrigeration circuit to the primary heat exchanger 160 to receive cooling in another mode (ice make mode). Valves 180-186 are placed in various places within the secondary refrigerant circuits to allow these multi-mode conditions with minimal complexity and plumbing. The valve types and configurations presented are specified for demonstrative purposes and any variety of valve or circuit configurations may be used in conjunction with the disclosed systems and fall within the scope of the invention. Acting as a collector and phase separator of multi-phase refrigerant, an accumulator or universal refrigerant management vessel (URMV) 146 is in fluid communication with both the thermal energy storage unit 106 and the evaporator coil 122. A liquid refrigerant pump 120 is placed on the downstream side of the URMV 146 to pump refrigerant through refrigerant loops to either the evaporator coil 122 or the thermal energy storage unit 106 depending upon the current mode.

The embodiment illustrated in FIG. 1 utilizes the air conditioner unit 102 as the principal cooling source. The thermal energy storage unit 106 operates using an independent refrigerant (or phase change) loop that transfers the heat between the air conditioner unit 102 and the thermal energy storage unit 106 or a load, represented by the evaporator coil 122. The disclosed embodiment functions in two principal modes of operation, ice-make (charging) and ice-melt (cooling) mode.

In ice-make mode, compressed high-pressure refrigerant leaves the air conditioner unit 102 through high-pressure liquid supply line 112 and is fed through an expansion valve 130 to cool the primary side of the isolating heat exchanger 162. Warm liquid and vapor phase refrigerant leaves the isolating heat exchanger 162, returns to the air conditioner unit 102 through the low pressure return line 118 and is fed to the compressor 110 and re-condensed into liquid. The heat transfer between the primary loop and the secondary loop is accomplished by the isolating heat exchanger 162. Fluid leaving the isolating heat exchanger 162 on the secondary side flows to the URMV 146 where the cooled liquid phase refrigerant is accumulated and stored. The fluid leaves the URMV 146 and is pumped by a liquid refrigerant pump 120 to the thermal energy storage unit 106 where it enters the primary heat exchanger 160 through the lower header assembly 156 and is then distributed through the freezing coils 142 which act as an evaporator. Cooling is transmitted from the freezing coils 142 to the surrounding fluid 152 that is confined within the insulated tank 140 and eventually produces a block of ice surrounding the freezing coils 142 and storing thermal energy in the process. Warm liquid and vapor phase refrigerant leave the freezing coils 142 through the upper header assembly 154 and exit the thermal energy storage unit 106 returning to the isolating heat exchanger 162 being cooled and condensed once again.

In ice-melt mode, cool liquid refrigerant leaves URMV 146 and is pumped by a liquid refrigerant pump 120 to the evaporator coil 122 where cooling is transferred to a load. Warm liquid and vapor phase refrigerant leave evaporator coil 122 where the liquid phase is returned to the upper portion of the URMV 146 and vapor phase refrigerant is fed to the upper header assembly 154 of the thermal energy storage unit 106. Vapor phase refrigerant proceeds through the discharge coils 142 drawing cooling from the block of ice 152 surrounding the coils, where warm refrigerant is cooled and condensed to cool liquid phase refrigerant. This cool liquid phase refrigerant leaves the primary heat exchanger 160 via the lower header assembly 156 and exits the thermal energy storage unit 106 where it is fed into the lower portion of the URMV 146. The two principal modes of operation, ice-make and ice-melt performed with the apparatus of FIG. 1 are accomplished with the use of a series of valves 180-186 that control the flow of refrigerant through various apparatus which can perform dual functions depending upon the mode.

Because the system isolates a primary refrigerant loop 101 from a secondary refrigerant loop 103, the system additionally allows the use of different refrigerants to be used within the device. For example, one type of highly efficient refrigerant that may have properties that would discourage use within a dwelling (such as propane) may be utilized within the primary refrigerant loop 101, while a more suitable refrigerant (such as R-22 or R-410A) can be used for the secondary refrigerant loop 103 that may enter the dwelling. This allows greater versatility and efficiency of the system while maintaining safety, environmental and application issues to be addressed.

Figure 3:
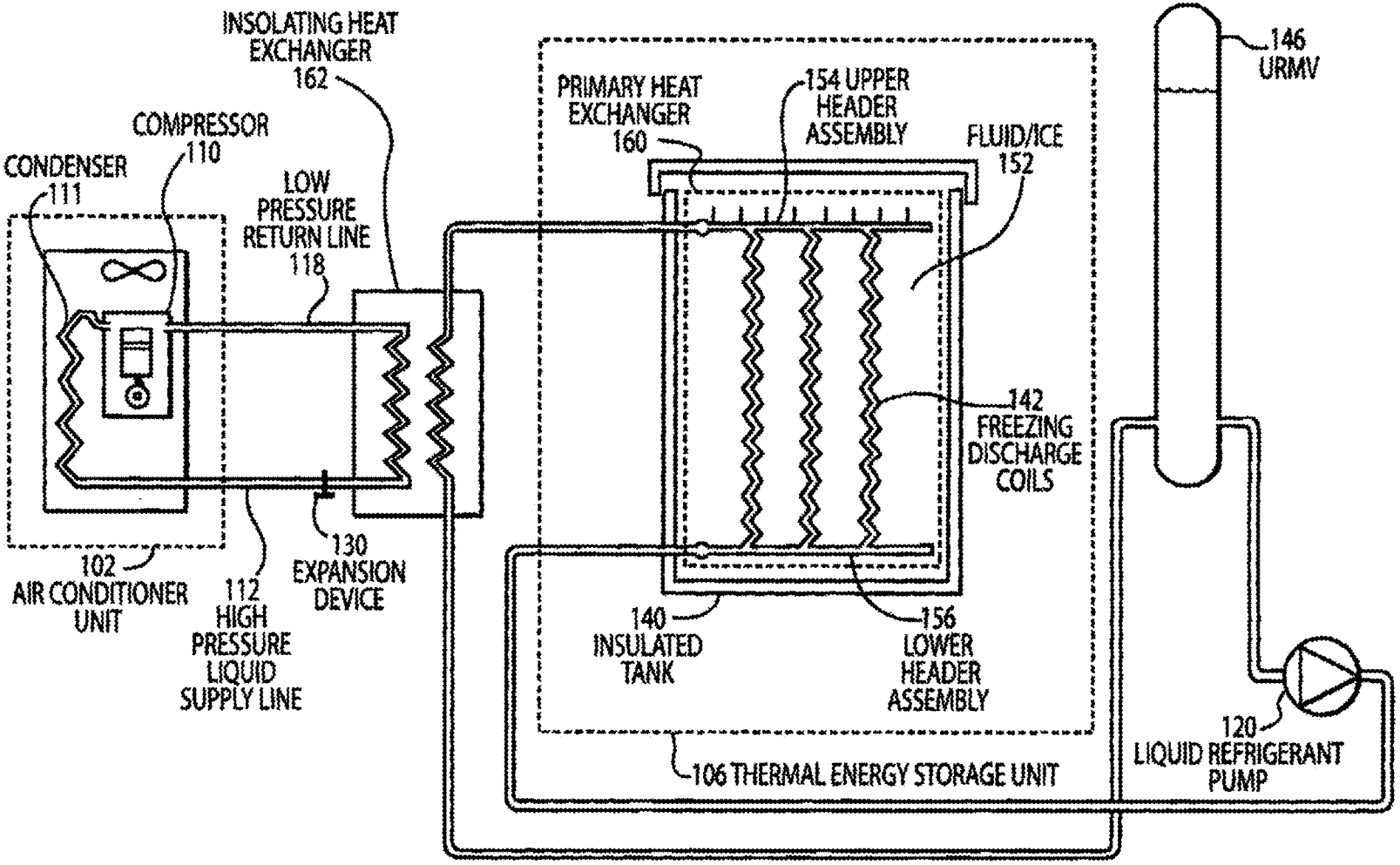
FIG. 3 illustrates a configuration of a refrigerant-based thermal energy storage and cooling system with secondary refrigerant isolation during an ice-make (charging) cycle.

FIG. 2 is a table representing valve status conditions for the refrigerant-based energy storage and cooling system with secondary refrigerant isolation 200 that is illustrated in FIG. 1. As shown in the table of FIG. 2, during the ice-make process, valve #1 180 is in a closed condition, valve #2 182 allows flow only from the thermal energy storage unit 106 to the isolating heat exchanger 162, and valve #4 186 directs flow from the liquid refrigerant pump 120 to the thermal energy storage unit 106. With the valves in this state, the evaporator coil is removed from the secondary loop. This causes refrigerant to flow through the primary heat exchanger 160, which acts as an evaporator, and returns refrigerant through valve #2 to the isolating heat exchanger 162 acting as a condenser. Valve #3 184 allows flow only between the refrigerant pump and the thermal energy storage unit 106. With each of the valves 180-186 in this ice-make condition, the system flows as shown in FIG. 3.

Figure 4:
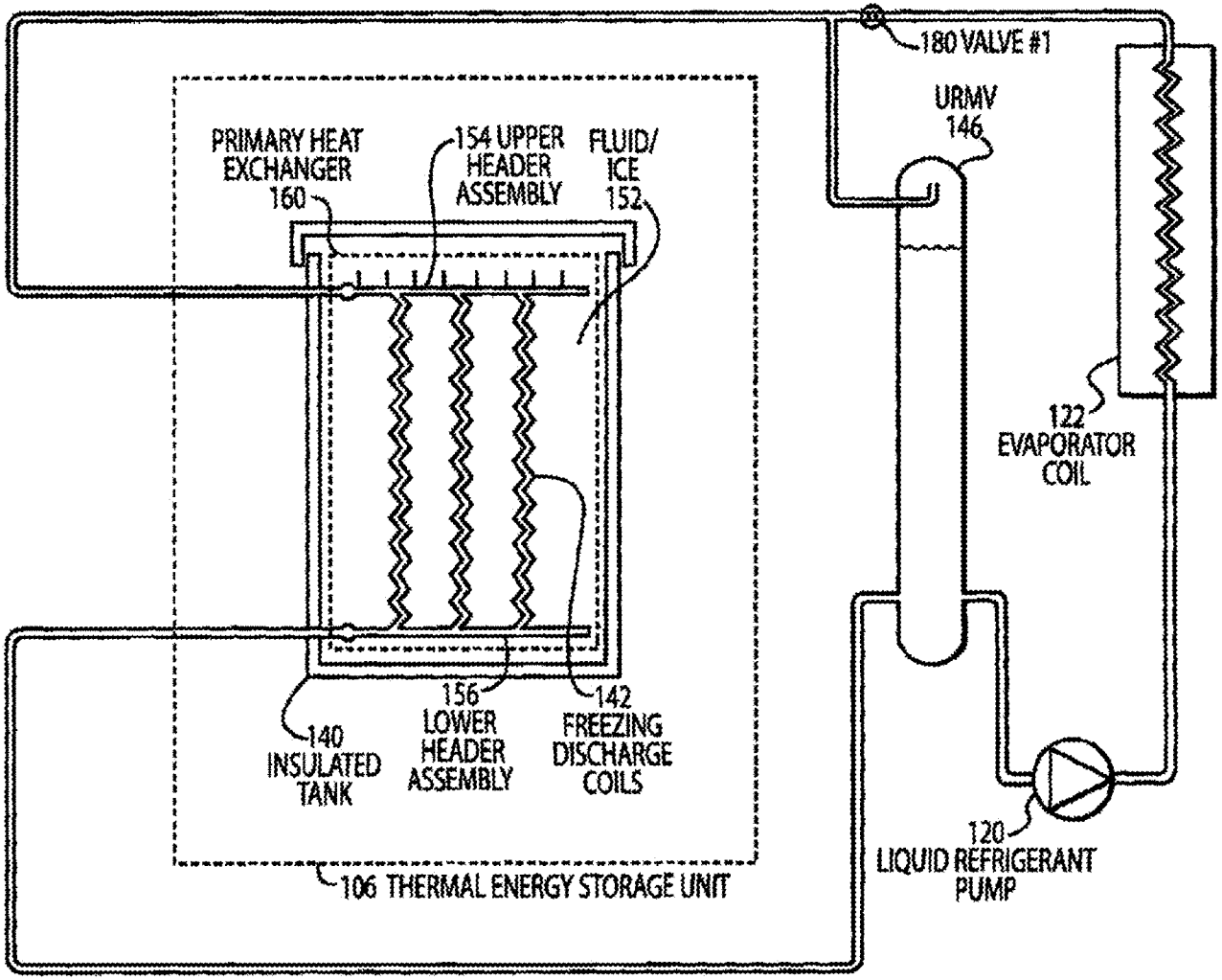
FIG. 4 illustrates a configuration of a refrigerant-based thermal energy storage and cooling system with secondary refrigerant isolation during an ice-melt (cooling) cycle.

During the ice-melt process, valve #4 186 directs flow from the liquid refrigerant pump 120 to the evaporator coil 122, valve #1 180 is in an open condition, and valve #2 182 allows flow only from the evaporator coil 122 to the thermal energy storage unit 106 and the URMV 146. With the valves in this state, the evaporator coil receives cooling to transfer to a load. This causes refrigerant to flow through the primary heat exchanger 160 in the opposite direction as in the ice-make mode and allows the primary heat exchanger to act as a condenser. Valve #3 184 allows flow only between the thermal energy storage unit 106 and the URMV 146. With each of the valves 180-186 in this ice-melt condition, the system flows as shown in FIG. 4.

As described in the above embodiment, the isolating heat exchanger 162 acts as an evaporator for the air conditioner unit 102 and as a condenser for the thermal energy storage unit 106. As a result, the air conditioner unit 102 operates at a lower suction temperature, but the loss in efficiency is overpowered by the decrease in cost of the system. During the ice-melt process, there are two options available. The refrigerant can be fed from the thermal energy storage unit 106 to the evaporator coil 122 as shown in FIG. 1, or the evaporator coil 122 can be utilized as yet another heat exchanger to exchange heat with yet another circuit. This option will entail usage of an additional pump to drive the additional circuit.

Additionally shown in the table of FIG. 2 is a condition in which the thermal energy storage capacity of the system may be bypassed and the air conditioner unit 102 is utilized to provide direct cooling to the evaporator coil 122. During the direct cooling process, valve #1 180 is in an open condition, valve #2 182 allows flow from the evaporator coil 122 to the isolating heat exchanger 162 and the URMV 146, valve #3 184 is closed and valve #4 186 directs flow from the liquid refrigerant pump 120 to the evaporator coil 122. With the valves in this state, the thermal energy storage unit is removed from the secondary loop. This causes refrigerant to flow through the isolating heat exchanger 162, which acts as a condenser, and returns refrigerant through the URMV 146 to the evaporator coil 122. With each of the valves 180-186 in this direct cooling condition, the system flows as shown in FIG. 5.

FIG. 3 illustrates a configuration of the refrigerant-based energy storage and cooling system with secondary refrigerant isolation of FIG. 1 during an ice-make (charging) cycle. With each of the valves 180-186 in the ice-make mode, as detailed in the table of FIG. 2, compressed high-pressure refrigerant leaves the air conditioner unit 102 through the high-pressure liquid supply line 112 and is fed through an expansion valve 130 to cool the primary side of the isolating heat exchanger 162. Warm liquid and vapor phase refrigerant leave the isolating heat exchanger 162 and returns to the air conditioner unit 102 through the low pressure return line 118 and is fed to the compressor 110 where it is recondensed into liquid. The heat transfer between the primary loop and the secondary loop is accomplished by the isolating heat exchanger 162. Fluid leaving the isolating heat exchanger 162 on the secondary side flows to the URMV 146 where the cooled liquid phase refrigerant is accumulated. The fluid leaves the URMV 146 and is pumped by a liquid refrigerant pump 120 to the thermal energy storage unit 106 where it enters the primary heat exchanger 160 through the lower header assembly 156 and is then distributed through the freezing coils 142 which act as an evaporator. Cooling is transmitted from the freezing coils 142 to the surrounding fluid 152 that is confined within insulated tank 140 and eventually produces a block of ice surrounding the freezing coils 142 and storing thermal energy in the process. Cool liquid and vapor phase refrigerant leave the freezing coils 142 through upper header assembly 154 and exit the thermal energy storage unit 106 and return to the isolating heat exchanger 162 and are cooled and condensed once again.

FIG. 4 illustrates a configuration of the refrigerant-based energy storage and cooling system with secondary refrigerant isolation of FIG. 1 during an ice-melt (cooling) cycle. With each of the valves 180-186 in the ice-melt mode, as detailed in the table of FIG. 2, cool liquid refrigerant leaves URMV 146 and is pumped by a liquid refrigerant pump 120 to the evaporator coil 122 where cooling is transferred to a load. Warm liquid and vapor phase refrigerant leave evaporator coil 122 where the liquid phase is returned to the upper portion of the URMV 146 and vapor phase refrigerant is fed to the upper header assembly 154 of the thermal energy storage unit 106. Vapor phase refrigerant proceeds through the discharge coils 142 drawing cooling from the block of ice 152 surrounding the coils where it is cooled and condensed to cool liquid phase refrigerant. This cool liquid phase refrigerant leaves the primary heat exchanger 160 via the lower header assembly 156 and exits the thermal energy storage unit 106 where it is fed into the lower portion of the URMV 146.

Figure 5:
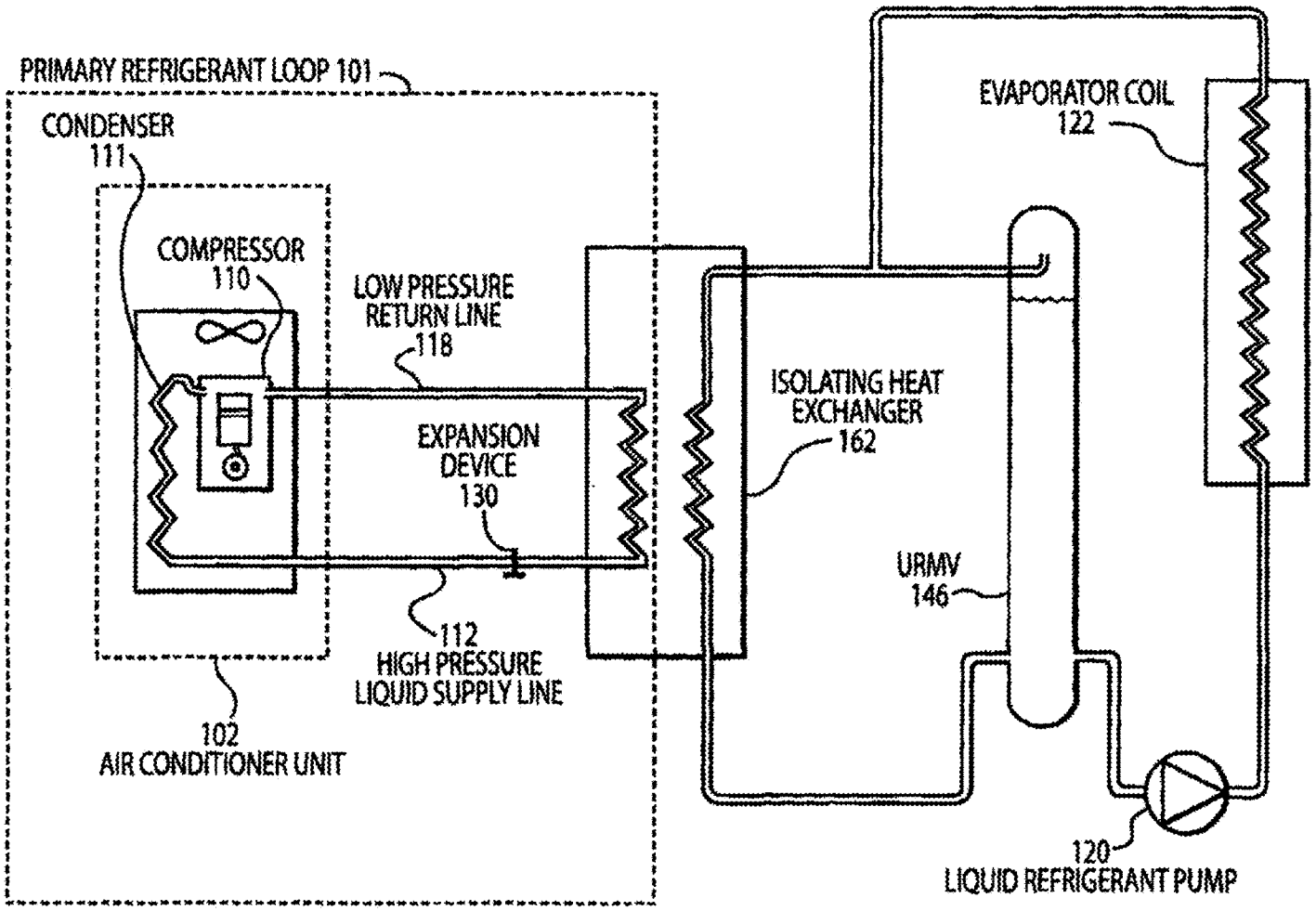
FIG. 5 illustrates a configuration of a refrigerant-based thermal energy storage and cooling system with secondary refrigerant isolation during a direct cooling (bypass) cycle.

FIG. 5 illustrates a configuration of the refrigerant-based energy storage and cooling system with secondary refrigerant isolation of FIG. 1 during a direct cooling cycle. In this configuration the thermal energy storage unit is bypassed and cooling is delivered directly from the condenser 111 to the evaporator coil 122 through the isolating heat exchanger 162. With each of the valves 180-186 in the direct cooling mode, as detailed in the table of FIG. 2, the air conditioning unit 102 transfers cooling to the primary side of the isolating heat exchanger 162 where cooling is transferred to the secondary side to cool and condense refrigerant in the secondary loop. Cooled liquid refrigerant leaves the isolating heat exchanger 162 and is accumulated in the URMV 146. Cool liquid refrigerant leaves URMV 146 and is pumped by a liquid refrigerant pump 120 to the evaporator coil 122 where cooling is transferred to a load. Warm liquid and vapor phase refrigerant leave evaporator coil 122 where the liquid phase is returned to the upper portion of the URMV 146 and vapor phase refrigerant is fed back to the isolating heat exchanger 162.

Figure 6:
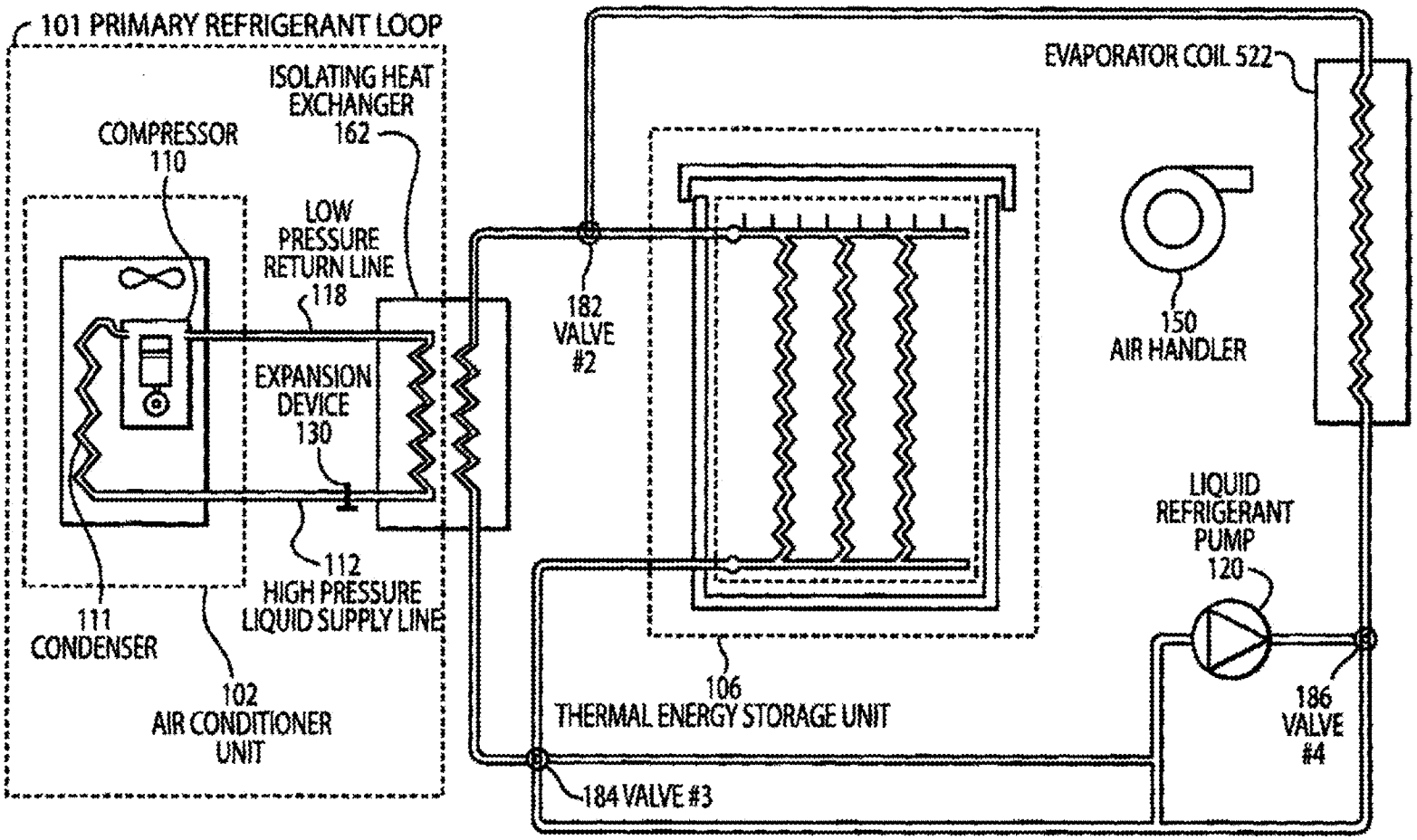
FIG. 6 illustrates another embodiment of a refrigerant-based thermal energy storage and cooling system with secondary refrigerant isolation.

FIG. 6 illustrates another embodiment of a refrigerant-based energy storage and cooling system with secondary refrigerant isolation. This embodiment functions without the need for an accumulator vessel or URMV reducing cost and complexity of the system. The embodiment of FIG. 6 utilizes the same primary refrigeration loop 101 as shown in FIG. 1 using an air conditioner unit 102 with a compressor 110 and condenser 111 creating high-pressure liquid refrigerant delivered through a high-pressure liquid supply line 112 to an isolating heat exchanger 162 through an expansion valve 130 and low-pressure refrigerant then being returned to compressor 110 via low pressure return line 118. Cooling is transferred to a secondary refrigeration loop including a thermal energy storage unit 106 through the isolating heat exchanger 162. This thermal energy storage unit 106 is structurally comparable to that depicted in FIG. 1, and acts as an evaporator in the ice-make mode and as a condenser in the ice-melt mode. An evaporator coil 122 in conjunction with an air handler 150 is connected within the secondary closed loop refrigeration circuit to the isolating heat exchanger 162 to transmit cooling from the primary refrigeration loop 101 and provide isolated, direct cooling in one mode.

The evaporator coil 122 is also connected within the closed secondary loop refrigeration circuit to the thermal energy storage unit 106 to receive cooling in another mode (thermal storage cooling). Valves 182-186 are placed in various places within the secondary refrigerant circuits to allow these multi-mode conditions with minimal complexity and plumbing. The valve types and configurations presented are specified for demonstrative purposes and any variety of valve or circuit configurations may be used in conjunction with the disclosed systems and fall within the scope of the invention. A liquid refrigerant pump 120 in placed in the secondary refrigeration loop to pump refrigerant to either the evaporator coil 122 or the thermal energy storage unit 106 depending upon the current mode.

The present embodiment also functions in two principal modes of operation, ice-make and ice-melt mode. In ice-make mode, the primary refrigerant loop 101 is used to cool the primary side of the isolating heat exchanger 162 that transfers heat to the secondary loop. Fluid leaving the isolating heat exchanger 162 on the secondary side flows to the liquid refrigerant pump 120 where the cooled liquid phase refrigerant is distributed to the thermal energy storage unit 106 acting as an evaporator. The liquid refrigerant pump 120 is placed below the level of the isolating heat exchanger 162 so that sufficient liquid head above the pump can be maintained. Cooling is transmitted to fluid that is confined within the thermal energy storage unit 106 thus storing thermal energy. Warm liquid and vapor phase refrigerant leaves the thermal energy storage unit 106 and returns to the isolating heat exchanger 162 and is cooled and condensed once again.

In ice-melt mode, cool liquid refrigerant is drawn from the thermal energy storage unit 106 and is pumped by a liquid refrigerant pump 120 to the evaporator coil 122 where cooling is transferred to a load with the aid of an air handler 150. Warm mixture of liquid and vapor phase refrigerant leaves the evaporator coil 122 where the mixture is returned to the thermal energy storage unit 106 now acting as a condenser. Vapor phase refrigerant is cooled and condensed by drawing cooling from the cold fluid or ice. As with the embodiment of FIG. 1, two principal modes of operation, ice-make and ice-melt are performed with the use of a series of valves 182-186 that control the flow of refrigerant through various apparatus which can perform multiple functions depending upon the mode.

Figure 7:
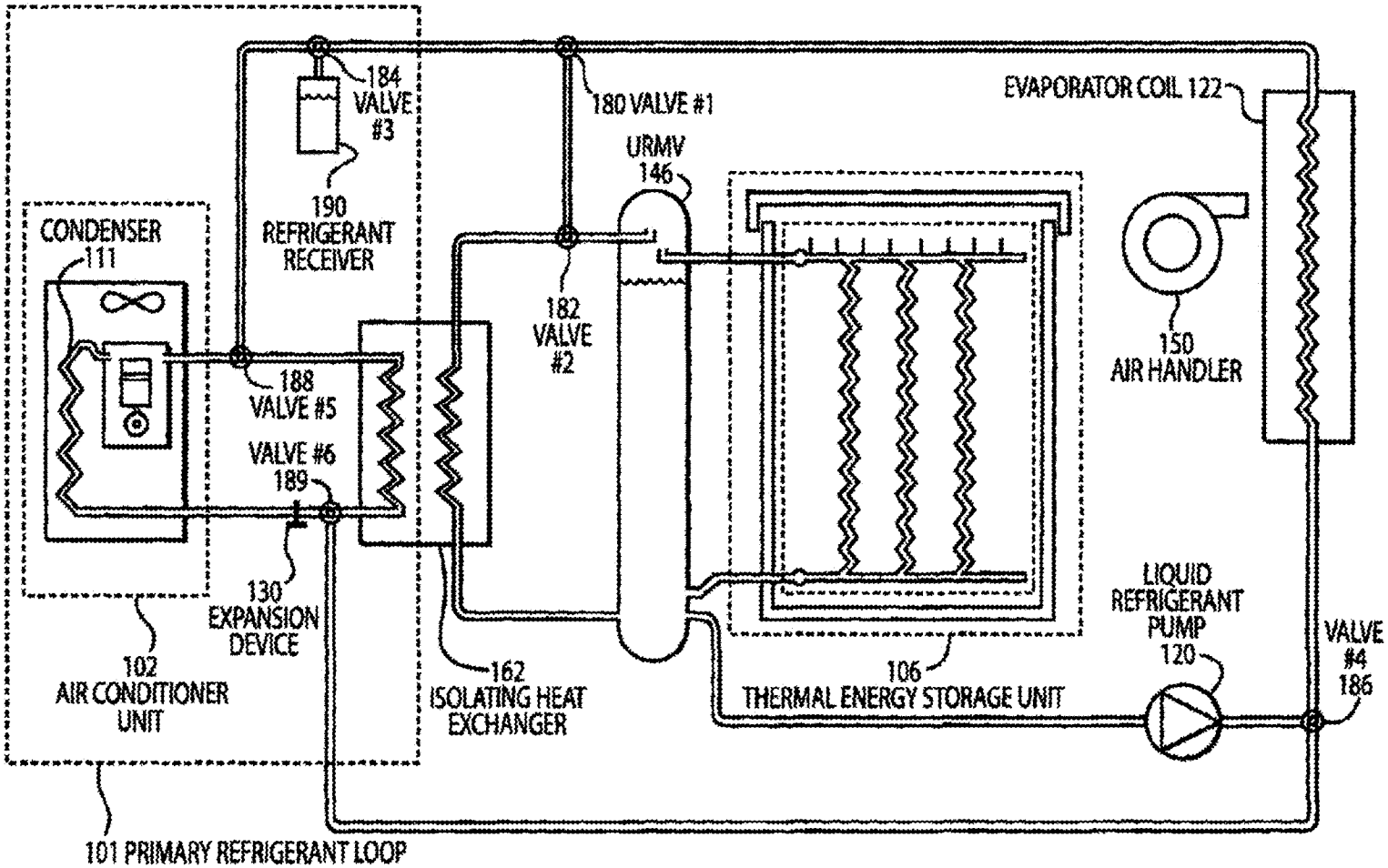
FIG. 7 illustrates another embodiment of a refrigerant-based thermal energy storage and cooling system with secondary refrigerant isolation.

FIG. 7 illustrates another embodiment of a refrigerant-based energy storage and cooling system. This embodiment deviates from the system of FIG. 1 by the location of the accumulator vessel and by the addition of a third mode of operation, a direct cooling mode that bypasses the secondary refrigeration isolation for use when direct cooling from the air conditioner unit 102 may be desirable. The embodiment of FIG. 6 utilizes the same primary refrigeration loop 101 as shown in previous embodiments but additionally adds a direct cooling loop to provide a non-isolated, direct loop to a cooling load from an air conditioner unit 102.

As with the previous bi-modal embodiments, the primary refrigerant loop 101 can be used to cool the primary side of the isolating heat exchanger 162 that transfers heat to the secondary loop. Fluid leaving the isolating heat exchanger 162 on the secondary side flows to the URMV 146 and is distributed as liquid refrigerant to either the thermal energy storage unit 106 (ice-make mode), or to the evaporator coil 122 through the liquid refrigerant pump 120 (ice-melt mode), and is then returned to the upper portion of the URMV 146.

In ice-make mode, cooling is transferred directly to the thermal energy storage unit 106 (acting as an evaporator) where the thermal energy is stored as ice. In ice-melt mode, cool liquid refrigerant is drawn from the thermal energy storage unit 106 through the URMV 146 and is pumped to the evaporator coil 122 where cooling is transferred to a load with the aid of an air handler 150. Warm liquid and vapor phase refrigerant leaves the evaporator coil 122 where the liquid phase is returned to the thermal energy storage unit 106 now acting as a condenser. Vapor phase refrigerant is accumulated in the upper URMV 146 and drawn into the thermal energy storage unit 106 where it is cooled and condensed with the cold fluid or ice.

With the current configuration of the energy storage and cooling system, an additional mode can be utilized which has the ability to provide non-isolated, direct cooling from the primary refrigeration loop 101 to the cooling load through the evaporator coil 122 with the aid of an air handler 150. In this mode the isolating heat exchanger 162 and the thermal energy storage unit 106 are bypassed to provide this direct cooling. As with the previously described embodiments, the principal modes of operation, ice-make, ice-melt, and direct cooling are performed with the use of a series of valves 180-189 that control the flow of refrigerant through various apparatus.

During the ice-make mode, valve #5 188 and valve #6 189 close the external loop to the evaporator coil 122 and retain the fluid within the primary refrigeration loop 101. Valves #1 180 and #4 186 are closed and valve #2 182 is open. During the ice-melt process, valve #5 188 and valve #6 189 remain in the ice-make condition retaining the fluid within the primary refrigeration loop 101. Valve #1 180 allows flow only from the evaporator coil 122 to the URMV 146 and valve #4 186 allows flow only from the liquid refrigerant pump 120 to the evaporator coil 122. During the direct cooling mode, valve #5 188 and valve #6 189 prevent flow to the isolating heat exchanger 162 and direct flow to the external loop of the evaporator coil 122. Valve #1 180 allows flow only from evaporator coil 122 to valve #3 184 that controls a refrigerant receiver 190, and flow to the air conditioner unit 102. Valve #4 186 allows flow only from the air conditioner unit 102 to the evaporator coil 122.

Figure 8:
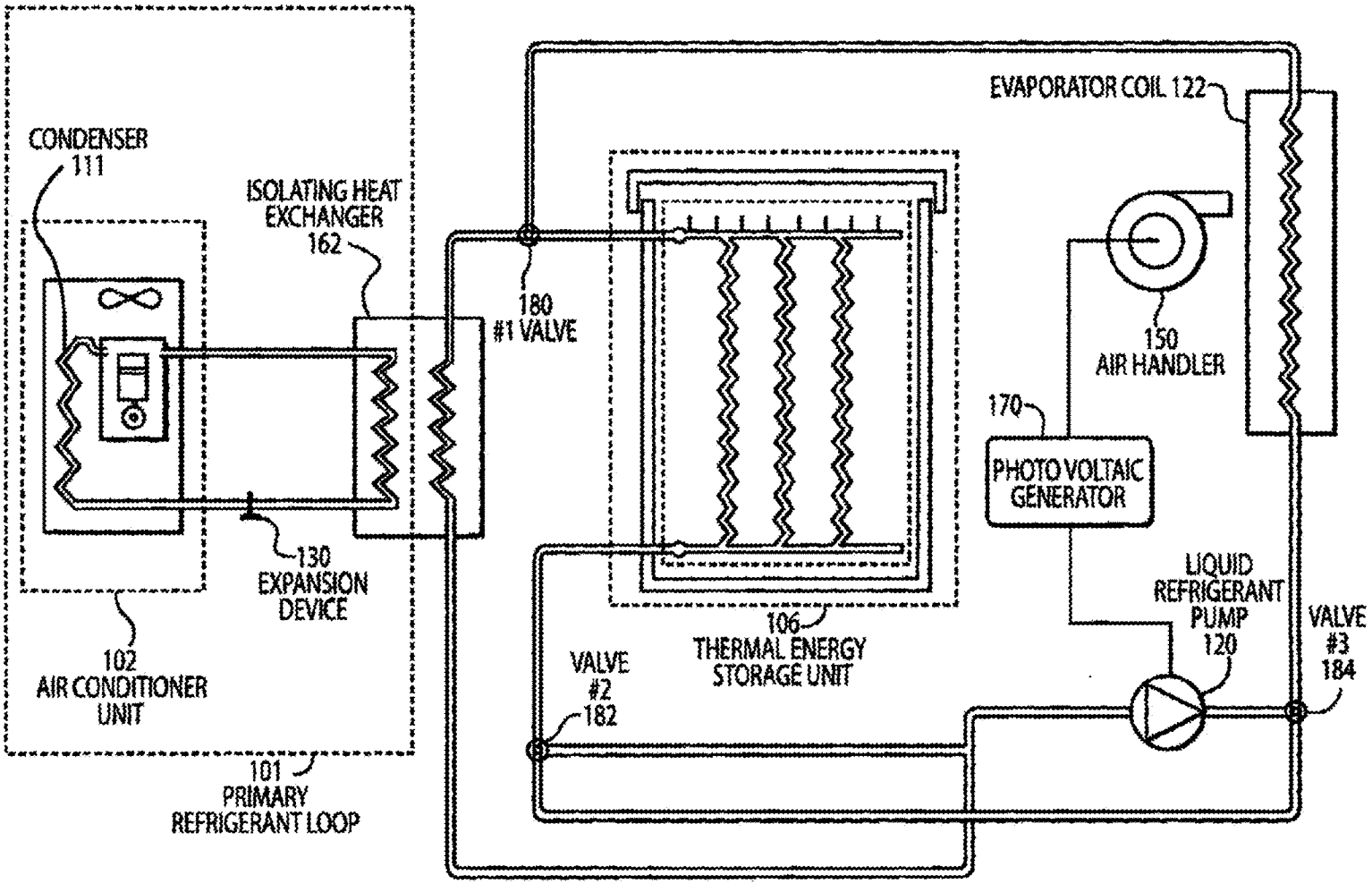
FIG. 8 illustrates an embodiment of a net-zero peak power refrigerant-based thermal energy storage and cooling system with secondary refrigerant isolation.

FIG. 8 illustrates an embodiment of a net-zero peak power refrigerant-based energy storage and cooling system with secondary refrigerant isolation. This embodiment is the system of FIG. 6 with the addition of a photovoltaic generator 170 placed within the apparatus to power the air handler 150 and the liquid refrigerant pump 120 during the ice-melt mode. This allows the system to be used during peak demand times at a net-zero power draw from a utility.

Integration with an External HVAC System

The preceding discussion leaves open the type of heat load that is cooled by evaporator coil 122 when the thermal energy storage and cooling system, henceforth referred to as system 1, is in ice melt mode. An important case arises when system 1 is integrated with an external HVAC unit. Typically, such an external HVAC unit is a commercially available HVAC unit capable of heating and cooling a building. The objective of such integration is to take advantage of the ability of system 1 to provide economical cooling during the hotter portion of the day, typically in the afternoon. It may be appreciated that system 1 refers generally to a thermal energy storage and cooling system that uses ice or cold water to cool and circulate a refrigerant and which functions economically by reducing the need for external electrical power during peak periods of electricity demand. Thus, system 1 may be implemented as any of the embodiments described herein, as well as by other embodiments that are reasonably with the scope of the present invention.

Figure 9:
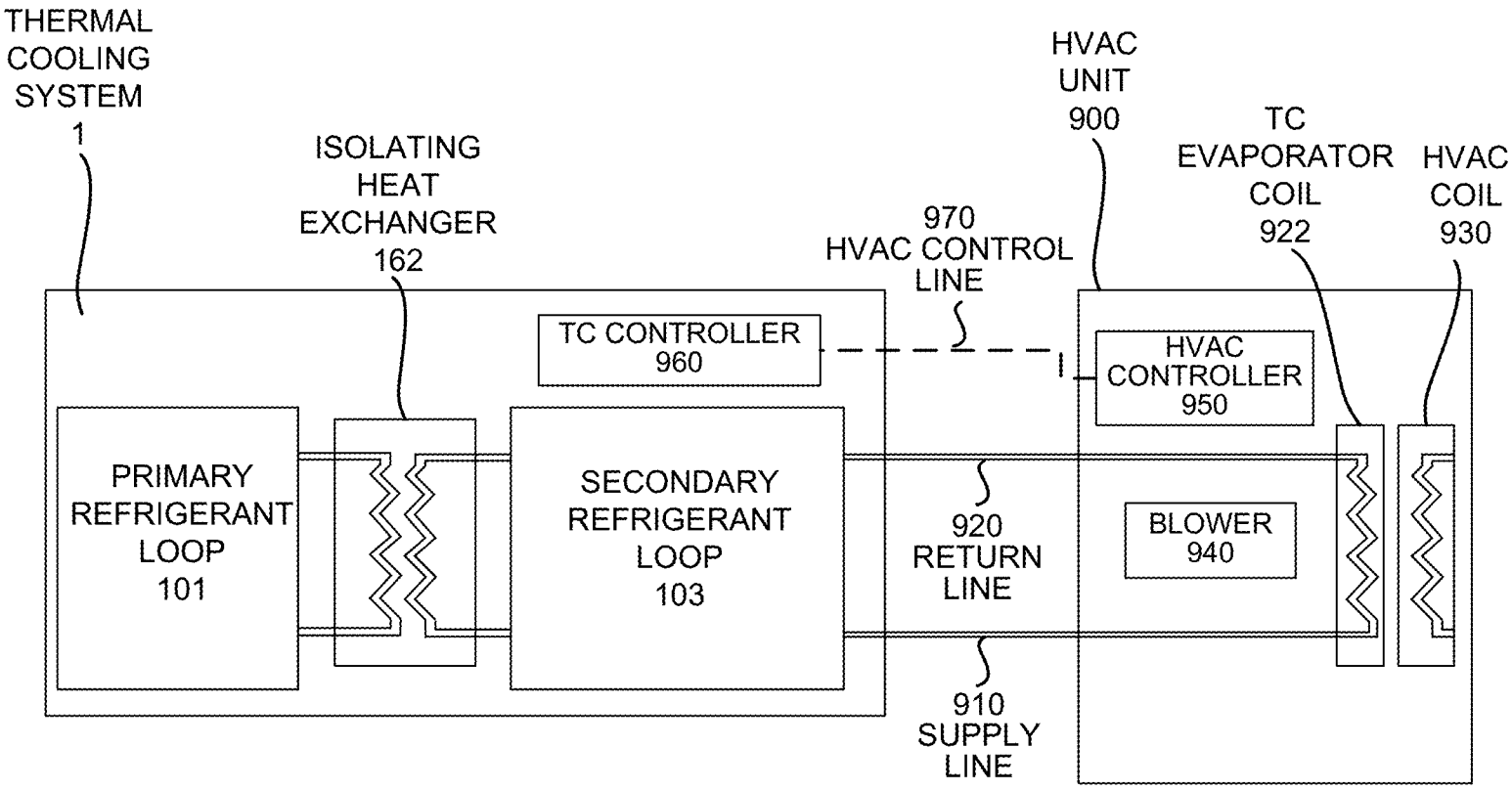
FIG. 9 illustrates one embodiment of the integration of a thermal cooling system 1 with an external HVAC unit.

FIG. 9 illustrates one embodiment of the integration of a thermal cooling system 1 with an external HVAC unit 900. Thermal cooling system 1 (henceforth "system 1") includes a primary refrigerant loop 101, an isolating heat exchanger 162 that transfers cooling to a secondary refrigerant loop 103 when operating in an ice make mode and transfers heat from secondary refrigerant loop 103 to primary refrigerant loop when operating in an ice melt mode. When operating in ice melt mode, secondary refrigerant loop transfers cold refrigerant through supply line 910 through a TC evaporator coil 922 where it transfers a portion of its cooling to an HVAC coil 930 within HVAC unit 900. Liquid phase and/or gas phase refrigerant returns via return line 920 to system 1 where it is cooled. While evaporator coil 922 may be considered a part of secondary refrigerant loop 103, in the embodiment of FIG. 9 it is physically integrated within HVAC unit 900, in close proximity to HVAC coil 930. Typically, TC evaporator coil 922 is positioned in a range of 0.01 to 6 inches from HVAC coil 930. It may be appreciated that TC evaporator coil 922 is an embodiment of evaporator coil 922 that is physically integrated within HVAC unit 900.

The precise structure and function of HVAC 900 is outside the scope of the present invention. Thus, no presumption about the structure or function of HVAC unit 900 is made other than as disclosed herein. Generally, HVAC unit 900 is presumed to be a commercially available HVAC unit. However, being commercially available is not a requirement of HVAC unit 900. For example, it may be inter alia an HVAC unit that is specifically designed to be integrated with system 1; or it may be a pre-existing HVAC unit that was not sold commercially. Furthermore, there is no presumption as to whether HVAC unit 900 operates inside or outside of a building.

A blower 940, which may also be referred to as an air handler, of HVAC unit 900, blows relatively warm air, for example air that is recirculated from a building or drawn from the building exterior, across TC evaporator coil 922 and HVAC coil 930, resulting in cooled air that is typically circulated within a building.

An HVAC controller produces an electric signal that is transmitted to a thermal cooling (TC) TC controller 960 within system 1 to request that system 1 provide cooling. In turn, TC controller 960 produces an electrical signal that is transmitted to HVAC controller 950 that controls aspects of the operation of HVAC unit 900. The operation of TC controller 960 is described in detail hereinbelow with reference to FIGS. 10 and 12. In certain embodiments, TC controller 960 and HVAC controller 950 communicate across a physical HVAC control line 970. In other embodiments a wireless communications method may be employed such as WiFi, wireless ethernet, or RF communications.

No presumption is made about the structure or function of HVAC controller 950 other than that it provides an electronic signal that can be interpreted as either requesting that system 1 provide cooling, or that system 1 does not need to provide cooling. In perhaps the simplest instance, HVAC controller 950 may be implemented as a signal from a thermostat providing a temperature or a request for cooling.

Figure 10:
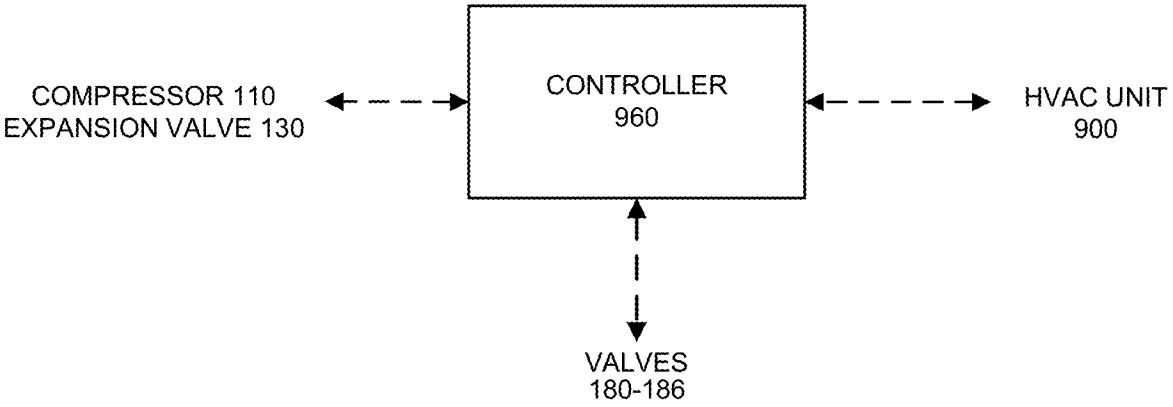
FIG. 10 illustrates a thermal cooling controller that controls the operation of a primary refrigerant loop, a secondary refrigerant loop, and which further illustrates the integration between embodiments of a refrigerant-based thermal energy storage and cooling system with secondary refrigerant isolation and an external HVAC unit.

FIG. 10 illustrates the TC controller 960, which controls the operation of primary refrigerant loop 101, secondary refrigerant loop 103 and the integration between system 1 and HVAC unit 900. TC controller 960 is typically implemented by a circuit board with a CPU, static and dynamic memory for storing program code and data, and electronic communication interfaces. In certain embodiments it may also include a battery and a housing. TC controller 960 is typically incorporated within the housing of system 1 but may be an independent unit, with its own housing, that is attached to or in proximity to system 1. In other embodiments, TC controller 960 may have a wireless transceiver that enables it to communicate with HVAC unit 900 and event with elements within system 1 wirelessly. TC controller 960 may also have an internet transceiver that enables it to communicate across the Internet.

TC controller 960 controls valves 1-4 180-186 to implement the various system modes described with reference to FIG. 2. In the embodiment of FIG. 7, TC controller 960 also controls valves 188, 189. In addition, in certain embodiment it also controls the operation of compressor 110 and expansion valve 130, also to manage transitions between system modes.

Integration with HVAC unit 900 is achieved by utilizing cooling provided by the refrigerant in TC evaporator coil 922 when two conditions are met: (1) the thermostat of HVAC unit 900 has determined that cooling is required, and (2) system 1 is in ice melt mode. Accordingly, the condenser/evaporator mechanism of HVAC unit 900 is halted when these conditions are met and pump 120 is started up in order to flow cool liquid refrigerant through supply line 910 and then through TC evaporator coil 922. Thus, during an ice melt mode, TC evaporator coil 922 supplies cooling that would otherwise be supplied by cool refrigerant in HVAC coil 930.

Figures 11A, 11B:
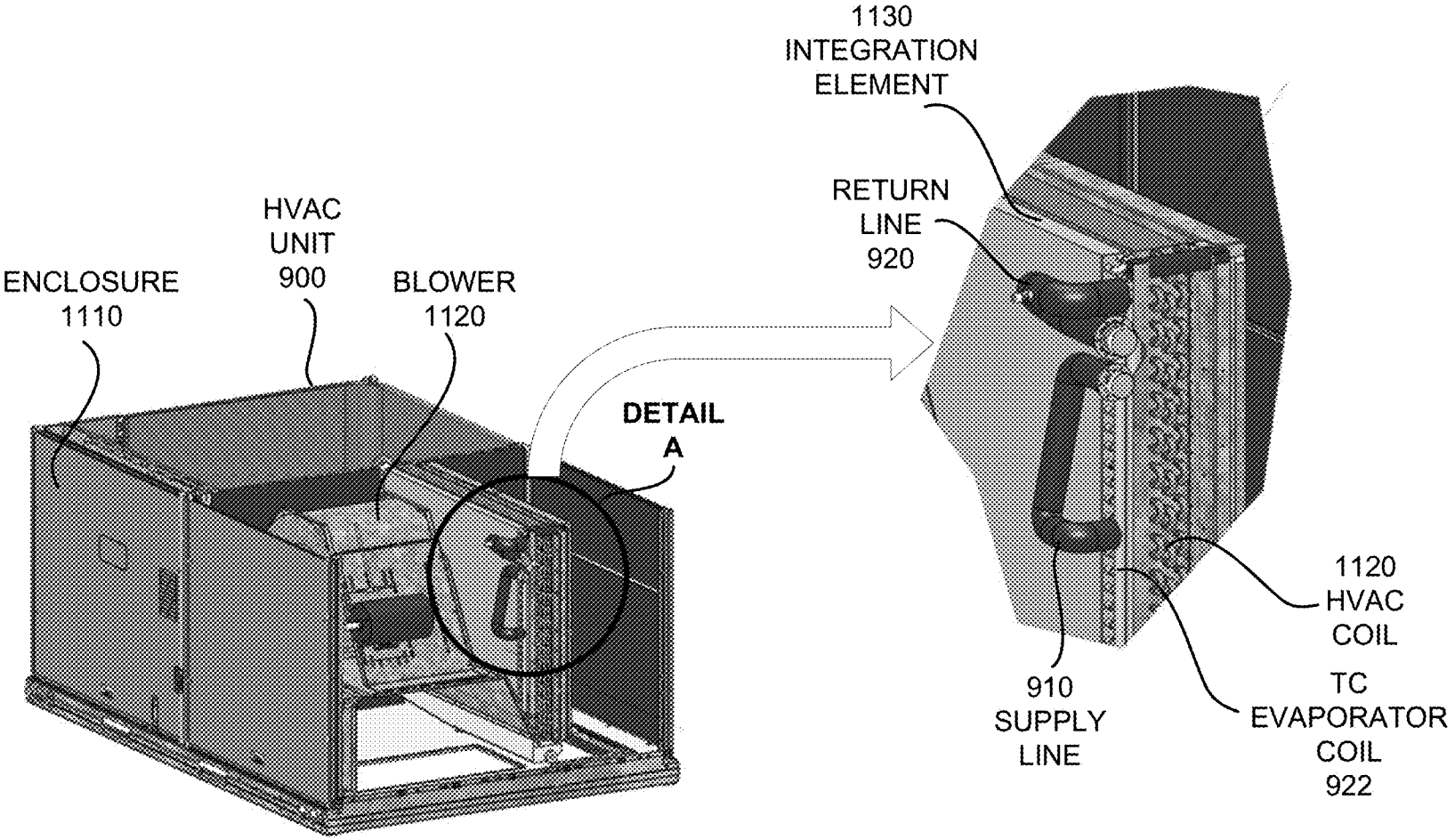
FIGS. 11A and 11B illustrate one embodiment of the integration between a refrigerant-based thermal energy storage and cooling system with secondary refrigerant isolation and an external HVAC unit.

FIGS. 11A-B illustrate one embodiment of the integration between system 1 and an external HVAC unit 900. FIG. 11A provides one view of the integration of evaporator coil 122 within the enclosure 1110 of HVAC unit 900 and FIG. 11B provides a detailed view of one section of FIG. 11A.

FIGS. 11A-B depict an HVAC unit 900, with an enclosure 1110, and a blower 1120. Blower 1120 is an embodiment of blower 940. An integration element 1130 is added next to a primary HVAC coil 1120. The integration element provides a housing for TC evaporator coil 922 and connection points for supply line 910 and return line 920. Integration element 1130 mounts adjacent to HVAC coil 1120. In certain embodiments, integration element 1130 may be a unit that simply slides in or is easily attached to the housing of HVAC unit 900. In other embodiments, parts required to integrate system 1 and HVAC unit 900 are attached to the housing of HVAC unit 900.

Supply line 910 and return line 920 are shown as being surrounded by a thermal sleeve made of a thermal insulating material such as rubber that conserves coolness. This allows supply line 910 and return line 920 to achieve substantial run lengths, e.g. in the range of 1 to 165 feet.

When the two conditions described hereinabove are met and TC controller 960 has enabled valves 180-186 per the ice melt mode valve settings of FIG. 2, as described with reference to FIG. 4, cool liquid refrigerant circulates through TC evaporator coil 922; typically, the compressor-condenser operation of HVAC unit 900 is halted, thus saving energy. And blower 940 blows relatively warmer air across TC evaporator coil 922 which results in relatively cooler air flowing through the ductwork of associated with HVAC unit 900. The refrigerant pumped through TC evaporator coil 922 is accordingly warmed. In the embodiment of FIG. 1 the liquid phase refrigerant returns to the upper portion of URMV 146 and vapor phase refrigerant is fed to the upper header assembly 154 of the thermal energy storage unit 106. In the embodiments of FIGS. 6, 7 and 8 the warm mixture of liquid and vapor phase refrigerant returns to the thermal energy storage unit 106 which acts as a condenser.

Figure 12:
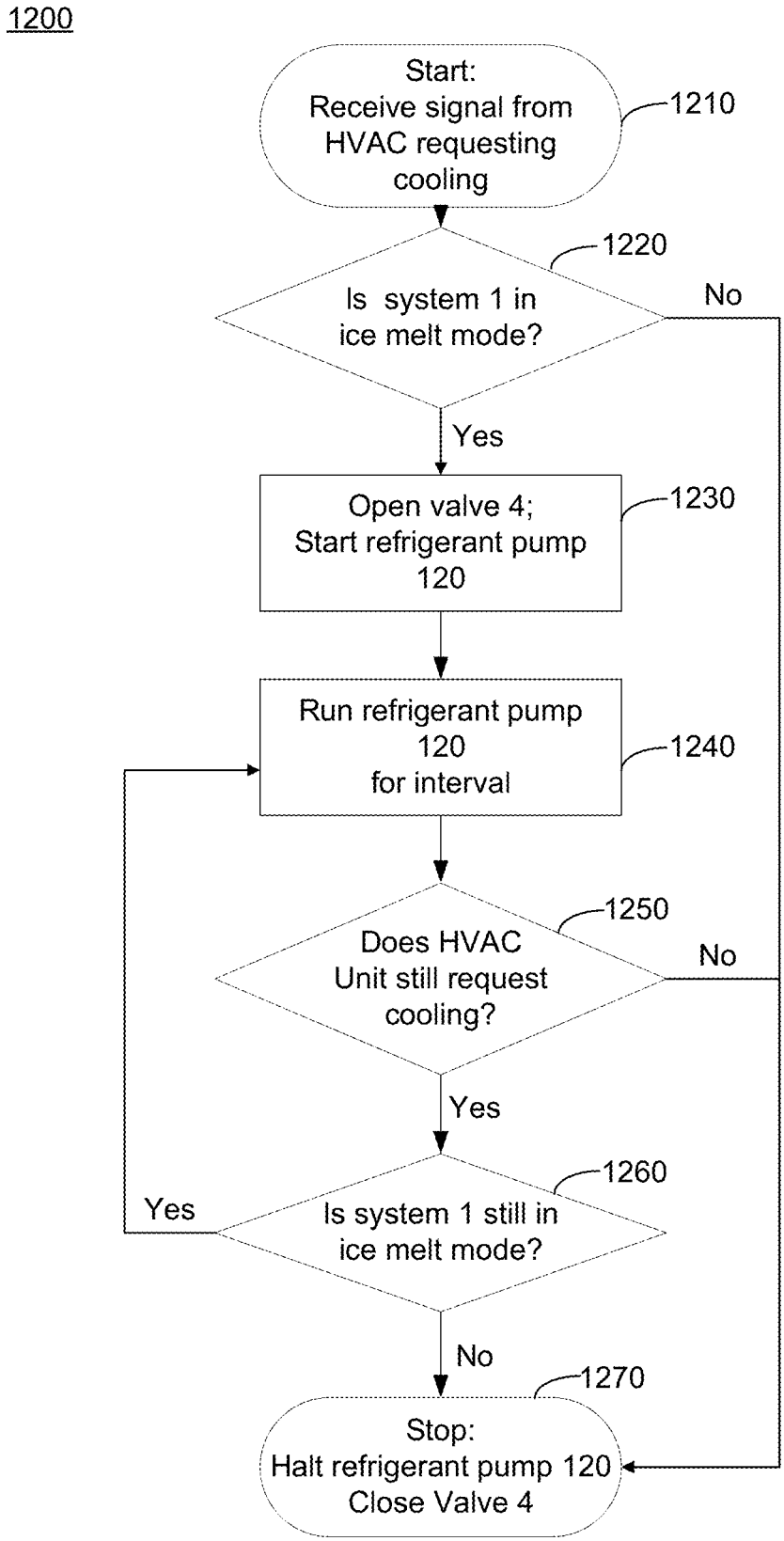
FIG. 12 is a flow diagram which illustrates one embodiment of a method performed by the thermal cooling controller (TC) controller 960 to manage the integration between a refrigerant-based thermal energy storage and cooling system with secondary refrigerant isolation and an external HVAC unit.

FIG. 12 is a flow diagram which illustrates an embodiment of a method 1200 performed by TC controller 960 to manage the integration between system 1 and HVAC unit 900. At step 1210 the method is initiated by a signal from HVAC controller 950 which requests cooling. For example, this may be as simple as a thermostat setting received by HVAC unit 900 which is also carried to TC controller 960. At step 1220 if system 1 is in ice melt mode, i.e. it is available to provide cooling, then the method flow to step 1230. If not, then the method halts at step 1270.

At step 1230 TC controller 960 issues signals to open valve 4 and to start refrigerant pump 120 which pumps liquid refrigerant through supply line 910 to TC evaporator coil 922.

At step 1240, refrigerant pump 120 runs or operates for a period of time. This is a preset value which may be very brief, on the order to milliseconds or seconds, or somewhat longer, on the order of several minutes.

At step 120 a determination is made as to whether HVAC unit 900 still requests cooling; typically, this occurs when the temperature sensed by a thermostat is above a desired temperature. If cooling is no longer requested, then the method terminates at step 1270. Otherwise, if cooling is still requested, the method flows to step 1260.

At step 1260, if system 1 is still in ice melt mode then the method repeats at step 1240. In not, the method terminates at step 1270.

At step 1270, the method terminates as no further cooling is to be supplied to HVAC unit 900. At this step the controller issues signals to halt pump 120 and to close valve 4.

Peak usage conditions for air conditioners generally come at times when the outside temperature is very high. At such times, it is difficult for the condenser to reject internal heat to the atmosphere. By utilizing the aforementioned embodiments, systems that overcome these conditions are realized. The disclosed systems incorporate multiple operating modes, the ability to add optional components, and the integration of smart controls that assure energy is stored at maximum efficiency. When connected to a condensing unit, the system stores energy in the form of frozen water, or ice, in a first time period and utilizes the stored energy during a second time period to provide cooling.

The detailed embodiments detailed above, offer numerous advantages such as minimizing additional components (and therefore, cost). In addition, the systems use very little energy beyond that used by the condensing unit to store the energy, in the form of frozen water or ice, and with the use of a photovoltaic generator, produces a net-zero power draw system during peak demand power rates. The refrigerant energy storage design has been engineered to provide flexibility so that it is practicable for a variety of applications and has further advantage over glycol or other single phase systems due to power consumption. This is because the heat load capacity of 1 lb. of refrigerant during phase change is 80 times the heat load capacity of 1 lb. of water. For example, to maintain the same heat load capacity of water (with a 10 degree F. temperature change) and refrigerant flow conditions, the power requirement for a refrigerant pump is about 5% a water pump.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

Upon reading this disclosure, those of skill in the art will appreciate still additional alternative structural and functional designs through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

What is claimed is:

1. A refrigerant-based thermal energy storage and cooling system that operates in two modes, an ice make mode and an ice melt mode, which provides cooling to an external heating, ventilation and air conditioning (HVAC) unit, wherein the external HVAC unit comprises an HVAC controller communicatively coupled with the thermal energy storage and cooling system, an HVAC condenser, an HVAC blower, and an HVAC coil, the thermal energy storage and storage system comprising:

a first refrigerant loop that circulates a first refrigerant, comprising:

an evaporator that cools the first refrigerant;

a second refrigerant loop containing a second refrigerant, comprising:

a tank filled with a fluid capable of a phase change between liquid and solid, wherein the tank uses the second refrigerant to cool the fluid and to freeze at least a portion of the fluid within the tank, wherein during ice melt mode the frozen fluid cools the second refrigerant;

an isolating heat exchanger, which has a portion inside the first refrigerant loop and a portion inside the second refrigerant loop, and which during ice make mode uses the cooled first refrigerant circulating in the first refrigerant loop to cool the second refrigerant circulating within the second refrigerant loop;

a thermal cooling (TC) controller operable to (1) receive a signal from the external HVAC system, wherein the received signal indicates that cooling is requested, and (2) upon receiving the signal, to transmit a signal to the HVAC controller to halt the HVAC condenser;

a refrigerant pump, which, upon receiving a signal from the TC controller indicating that cooling is requested, pumps cooled second refrigerant from the second refrigerant loop;

a thermal cooling (TC) evaporator coil that receives the cooled second refrigerant from the second refrigerant loop; and a physical integration element, mounted within the HVAC unit adjacent to the HVAC coil and the HVAC blower, which houses the TC evaporator coil and provides connection points for a supply line and return line, thus enabling the TC evaporator coil to transfer cooling to the HVAC coil.

2. The system of claim 1 wherein the first refrigerant loop comprises:

a condensing unit, said condensing unit comprising a compressor and a first condenser; and an expansion device connected downstream of said condensing unit; and a first evaporator on a primary side of an isolating heat exchanger located downstream of said expansion device;

wherein the first evaporator evaporates at least a portion of the first refrigerant to cool the first refrigerant.

3. The system of claim 2 wherein said expansion device is a mixed-phase regulator.

4. The system of claim 1 wherein the second refrigerant loop further comprises:

a second condenser on a secondary side of said isolating heat exchanger; and the liquid refrigerant pump for distributing the second refrigerant from to the evaporator coil; and wherein the tank further comprises:

a primary heat exchanger in fluid communication with said second condenser.

5. The system of claim 4 wherein the second refrigerant loop further comprises:

a refrigerant management vessel connected to receive the cooled second refrigerant from the tank;

and wherein the liquid refrigerant pump distributes the second refrigerant from the refrigerant management vessel to the evaporator coil.

6. The system of claim 5 wherein the second refrigerant loop further comprises:

a valve structure for isolating the second refrigeration loop within the isolating heat exchanger, the primary heat exchanger, the refrigerant management vessel, and the liquid refrigerant pump to form an ice-make circuit.

7. The system of claim 1 wherein the HVAC blower blows warm air across both the TC evaporator coil and the HVAC coil.

8. The system of claim 7 wherein the external HVAC controller is operable to transmit an electronic signal to the TC controller, wherein the signal indicates either that cooling is requested or that cooling is not requested.

9. The system of claim 7 wherein the TC evaporator coil is positioned within 0.1 to 6 inches of the evaporator coil of the external HVAC unit.

10. The system of claim 1 wherein said fluid is a eutectic material.

11. The system of claim 1 wherein said fluid is water.

12. The system of claim 1 wherein said first refrigerant is a different material from said second refrigerant.

* * * * *